United States Patent [19]

Maeder et al.

[11] 4,289,014

[45] Sep. 15, 1981

[54] DOUBLE ACTION DOMER ASSEMBLY

[75] Inventors: Edward G. Maeder, Minnetonka; John M. Tovey, Circle Pines, both of Minn.

[73] Assignee: National Can Corporation, Chicago, Ill.

[21] Appl. No.: 83,950

[22] Filed: Oct. 11, 1979

[51] Int. Cl.[3] ..... B21D 22/24

[52] U.S. Cl. ..... 72/348; 72/347

[58] Field of Search ..... 72/345, 347, 348, 349; 113/120 H

[56] References Cited

U.S. PATENT DOCUMENTS

| | | | |
|---|---|---|---|
| 3,735,629 | 5/1973 | Paramonoff | 72/349 |
| 3,760,751 | 9/1973 | Dunn et al. | 113/120 H |
| 3,771,345 | 11/1973 | Paramonoff | 72/349 |
| 3,786,667 | 1/1974 | Garnett, Jr. | 72/351 |
| 3,967,482 | 7/1976 | Kubacki et al. | 72/345 |
| 4,007,621 | 2/1977 | Fran et al. | 72/347 |
| 4,048,934 | 9/1977 | Wallace | 113/120 H |

*Primary Examiner*—Leon Gilden

*Attorney, Agent, or Firm*—Robert A. Stenzel; Ralph R. Rath

[57] ABSTRACT

A domer assembly for use with a punch reciprocable along a path on a frame of an ironing machine to reform an end wall of a container includes a center domer element surrounded by an annular element that projects beyond the surface of the center element with separate support means for the respective elements. The support means consists of a first support member carrying the center domer element with resilient compressible members interposed between the support member and the frame and a second support member supporting the annular element and also having a resilient member between the frame and the support. The respective resilient compressible members are identical in construction and are exposed so that they can readily be inspected, with independent separately pressurizable means for the respective compressible members.

15 Claims, 5 Drawing Figures

14
28
A
10
20
29
12
25
22
22
24
P
26

14
160
162
164
166
170
172
S
30
32
40
44
46
52
56
58
60
72
74
76
80
84
86
88
25

14
160
162
164
166
170
172
S
30
32
40
44
46
52
56
58
60
72
74
76
80
84
86
88
25

DOUBLE ACTION DOMER ASSEMBLY

DESCRIPTION

Technical Field

The present invention relates generally to drawing and ironing machines utilized for producing a container having a domed end wall and a unitary side wall for receiving beverages and more specifically a domer assembly for reforming the end wall of the container during the drawing and ironing process.

BACKGROUND OF THE INVENTION

Containers are currently being produced with exceedingly thin walls, having a thickness of 0.0038 inches or even less, which are obtained by first forming a flat circular metal disk into a shallow cup, reforming the shallow cup to produce a wall of intermediate length and then ironing the wall to reduce the thickness thereof and increase the height of the container shell. In this type of process, the integral or unitary end wall of the container is usually approximately the same thickness as the stock material that is utilized for forming the cup. Usually the end wall is reformed to some configuration, normally an inwardly domed configuration to increase the strength thereof.

The container shells formed of the above type are normally produced by what is commonly referred to as a drawing and ironing press which has a ram or punch that is reciprocable along a path and has a series of ironing dies aligned therewith as well as a redraw die at one end of the ironing dies and a stripper assembly at the opposite end. In most commercial presses, the press or drawing and ironing machine also includes a domer assembly that is positioned at the end of the stroke of the ram to cooperate with the ram or punch and reform the end wall at the end of the drawing and ironing operation.

One type of machine that has been utilized for producing container shells of the above type is manufactured by Ragsdale, Inc. and is identified as a model CR-24 Can Wall Drawing and Ironing Press. This machine includes a plurality of axially spaced die assemblies that cooperate with the movable punch to convert a shell cup into a finished container shell. At the end of the stroke, the punch cooperates with the domer assembly for producing the final configuration of the integral end wall of the container. Usually such end wall configuration is domed inwardly, as for example, is shown in the U.S. Pat. No. 3,942,673.

To produce such configuration, various types of doming assemblies have been proposed for cooperating with a punch to reform an end wall of a container shell. One example of such doming assemblies is disclosed in U.S. Pat. No. 3,491,574 wherein a fixed domer element is positioned in the path of movement of the punch adjacent the end of its stroke and has a surrounding stripper element for removing the finished shell from the domer assembly after the doming operation has been completed. One of the problems of having a fixed domer element for reforming the end wall of a container shell is that difficulties may be encountered when a cup is initially misfed onto the punch which can cause serious damage to the domer assembly as well as the remaining elements of the press or machine.

In an effort to reduce the cost of finished containers, manufacturers have constantly been striving to reduce the thickness of the initial stock material thereby decreasing the metal cost of each container. Since the end wall (bottom) of the container essentially represents the initial thickness of the can stock, new (improved) bottom profiles are required to maintain the pressure performance of thinner gauge. The container must be capable of maintaining internal pressures approaching 100 PSI minimum without any significant distortion and, to provide such capability, rather elaborate dome or end configurations have been developed.

One of the more recent proposals for the end wall configuration of the container consists of forming an inclined portion adjacent the lower periphery of the side wall and then inwardly doming the center portion of the end wall so that the lowest most edge of the container shell is located inwardly of the side wall.

In order to produce the more elaborate configurations of end walls for container shells, more elaborate equipment is necessary to prevent wrinkling of the metal during the reforming process. One example of a domer assembly for reforming an end wall to the configuration discussed above, is disclosed in U.S. Pat. No. 3,771,345. This patent discloses a center domer element surrounded by an annular domer element and both elements are maintained in a predetermined position through a pair of piston and cylinder arrangements wherein air is introduced to apply the desired forces to the container shell in cooperation with the punch. Another example of a domer assembly is disclosed in U.S. Pat. No. 3,730,383 wherein a fixed domer element is surrounded by a movable annular element that is biased through an air cylinder.

With arrangements of this type, it is virtually impossible to determine whether there is any leakage across the seals that are necessary between the stationary cylinder and the movable piston. In order to determine whether the seals have been damaged, it is necessary to completely disassemble components for a visual inspection. Such a process is not only time consuming but is costly in terms of loss of production.

Another type of biasing mechanism that has been utilized for a center domer element and an annular domer element is a spring assembly of the type disclosed in U.S. Pat. No. 3,967,482. Again, it is extremely difficult with spring arrangements of this type to insure that there is an equal force being applied around the perimeter of the container shell to act as a hold down pressure during reformation of the center of the container shell end wall. If the force applied to the periphery of the container end wall during the reforming of the center wall is not uniform and equal for each container, wrinkles may be encountered which makes it necessary to discard the container. Wrinkles result primarily from the resistance of the metal to flow from the side wall of the container into the end wall around the annular peripheral portion which has a reducing diameter. Of course, it is difficult with a spring biasing arrangement to accurately determine whether the forces for the respective springs are equal.

SUMMARY OF THE INVENTION

According to the present invention, a unique domer assembly has been developed which can be incorporated into existing machinery, such as the Ragsdale press referred to above, or a Standun, Inc. machine of the type disclosed in U.S. Pat. No. 3,735,629.

The domer assembly of the present invention incorporates a biasing mechanism which is a commercially available component that can readily be replaced at minimum cost and in a very short period of time. The domer assembly of the present invention is also designed such that the force applying components are fully exposed for visual inspection.

More specifically, the domer assembly of the present invention is designed for use with an ironing machine having a punch reciprocable along a path on the frame of the ironing machine in which the punch reforms the end wall of a container shell. The punch cooperates a center domer element and an annular domer element surrounding the center domer die or element with a domer support member and an annular support member respectively supporting the elements. A first compressible means or air bag is located between the domer support member and the frame while a second compressible means or air bag is located between the annular support member and the frame.

In the specific embodiment illustrated in the drawings, the first support member for the annular element consists of a rod that is located along the path of the punch and has a plurality of radial fingers at one end thereof which engage one end of the annular element and a single air bag is interposed between the opposite end of the rod and the frame. The center domer element is supported on a sleeve which surrounds the rod and has the domer element supported on one end thereof while three equally circumferentially spaced air bags are interposed between the opposite ends of the sleeve and the frame.

Separate pressurizing means are utilized for providing fluid, preferably a pneumatic fluid, such as air, to the individual air bag between the annular element and the frame and the three air bags between the center domer element and frame. The annular domer element and center domer element are normally maintained in a first position defined by the stops on the frame wherein the annular element extends beyond the periphery of the center domer element.

With this arrangement, initial contact is made by the annular element and the periphery of the end wall of the container to clamp the periphery portion between two surfaces on the respective members. The forces applied by the pressurized pneumatic fluid will contain the flow of metal from the side wall into the end wall to insure that there is no wrinkling during the reforming of the end wall.

The domer assembly is designed such that it can readily be incorporated into existing machinery with virtually no modification thereof.

DETAILED DESCRIPTION

Figure 1:
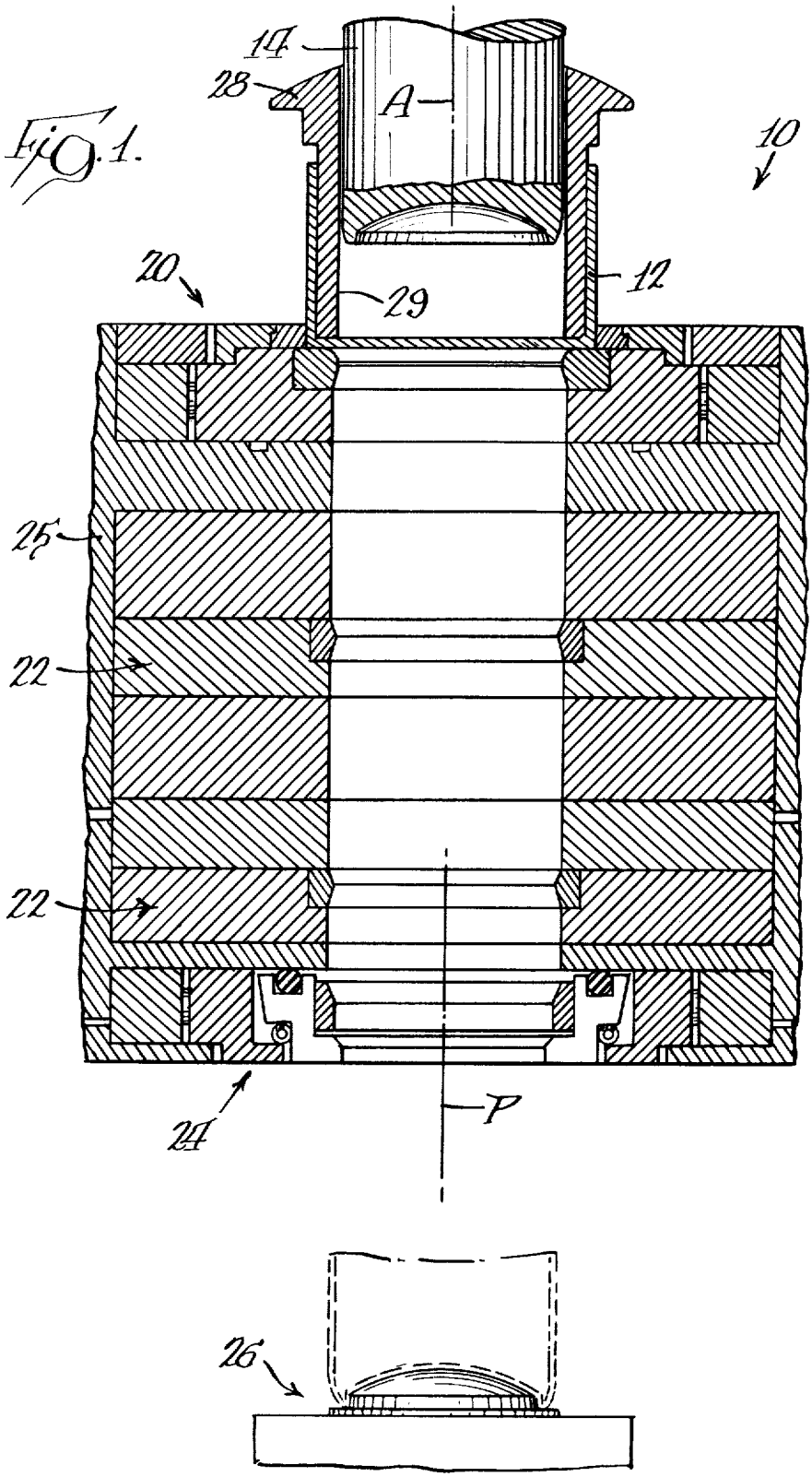
FIG. 1 of the drawings discloses a drawing and ironing assembly adapted to incorporate the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawing schematically illustrates selected portions of a bodymaker 10 for converting a cup 12 into a finished drawn and ironed container shell. Bodymaker 10, which may be a Ragsdale type machine identified above, includes a punch 14 which is supported on a press ram (not shown) and has its axis A moved mechanically along a predetermined path P and is supported on a frame 25 of the bodymaker press.

A plurality of die assemblies are located at axially spaced positions along path P and include a redraw assembly 20, a pair of ironing assemblies 22 and a stripper assembly 24. Assemblies 20, 22 and 24 are all supported on frame structure 25 which is part of the main frame of the press or may be separate cartridge units on the remainder of the press.

A domer assembly 26 is spaced from the stripper assembly 24 by a dimension which is greater than the height of the can. Bodymaker or press 10 also includes a cup holder sleeve 28 which cooperates with redraw assembly 20 and has an opening 29 for receiving punch 14. Cup holder sleeve 28 holds cup 12 as the punch is being forced through the redraw assembly 20. All of the apparatus described above is found in most conventional drawing and ironing machines.

According to the present invention, the domer assembly 26 is designed such that the entire assembly can readily be removed in a matter of minutes and replaced with a new assembly should any of the components become defective. Furthermore, the particular components necessary for applying the forces to the end wall of the container are all exposed for visual inspection at all times.

Figures 2, 3:
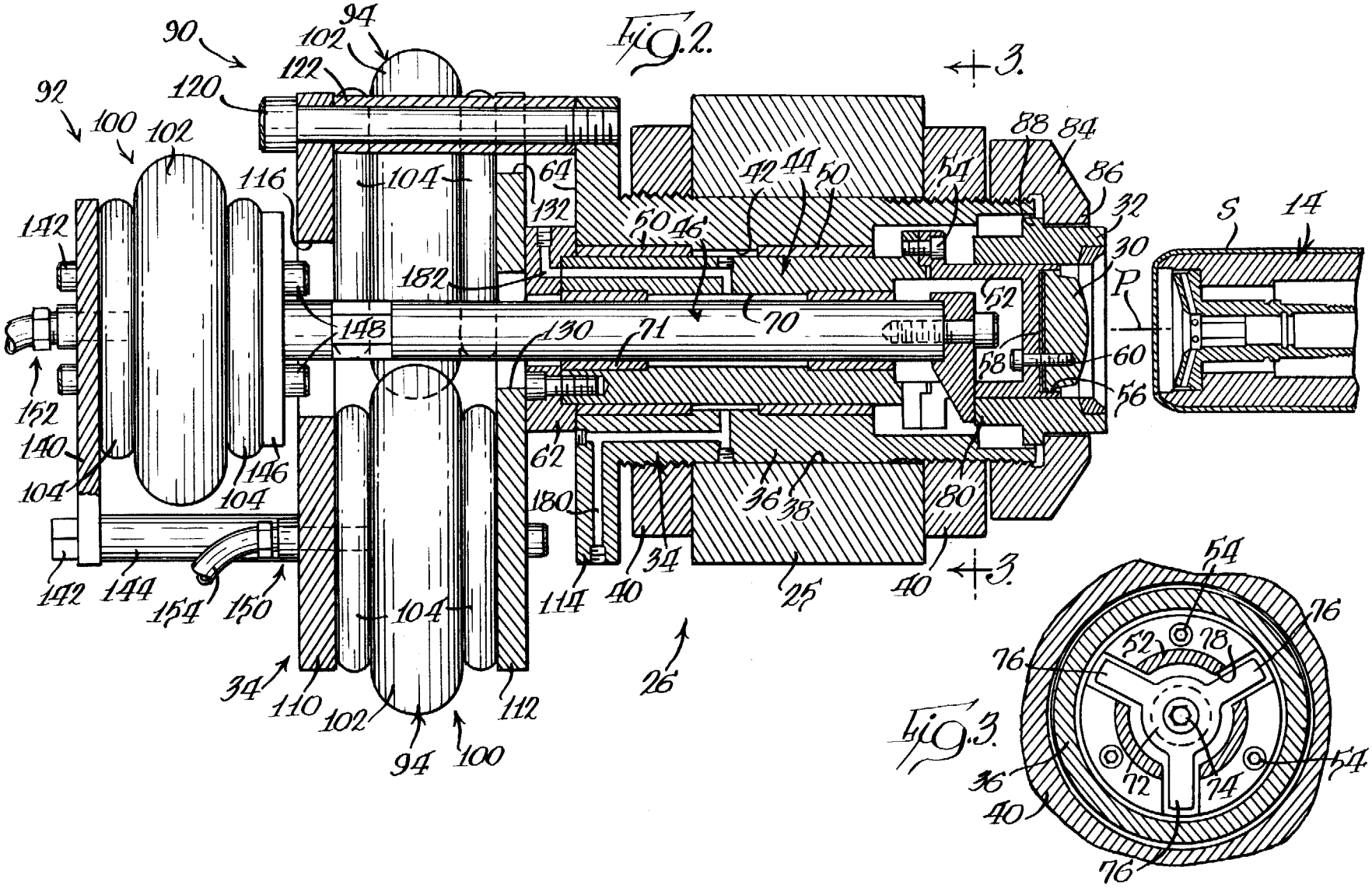
FIG. 2 is an enlarged fragmentary sectional view of the domer assembly of the present invention and a small portion of the punch or ram.
FIG. 3 is a cross-sectional view, as viewed along line 3—3 of FIG. 2.

As illustrated in FIG. 2 of the drawings, domer assembly 26 consists of a center domer element or die 30 and an annular domer element 32 which are supported on a frame structure 34 that is adapted to be attached to the frame structure 25 that forms part of the drawing and ironing press. Frame structure or support 34 consists of a threaded member 36 which it extends through an opening 38 in frame 25 and is retained thereon by a pair of threaded members 40 which are adapted to engage opposite surfaces of frame 25 to securely position and hold the frame or support 34 in a fixed position with respect to path P for punch 14. Support 34 has an annular or circular opening 42 in which first and second support members 44 and 46 are located. The first or domer support member 44 is in the form of an annular sleeve that is reciprocal along path P and has a pair of bearing members 40 interposed between the periphery of sleeve 44 and the internal surface of opening 42. A domer element support member 52 is secured to one end of sleeve 44 through a plurality of threaded studs 54 and has a recess 56 for receiving domer element 30. Suitable shims 58 may be interposed between the inner surface of domer element 30 and the base of recess 56 and the domer element is preferably held within recess 56 through threaded studs 60. The opposite end of sleeve 34 has an enlarged portion 62 that is adapted to engage a surface 64 on frame member 34 to define a first position for domer element 30, as will be described later.

The second or domer support member 46 consists of a substantially cylindrical rod that extends through an opening 70 in first member or sleeve 44 with suitable bearings 71 interposed between the periphery of rod 46 and the opening 70. One end of rod 46 has a member 72 secured thereto by a threaded stud 74 (FIG. 2) and member 72 has a plurality of radially extending fingers 76 circumferentially spaced around the path P. Fingers 76 extend through openings 78 in sleeve 44 and engage an inner end 80 of annular element 32. A bonnet 84 is threaded onto the periphery of member 34 and has an inwardly directed flange portion 86 aligned with an outwardly directed flange 88 on annular element 32. Thus, rod 46, fingers 76 and annular element 32 are biased as a unit into a first position, defined by flanges 86 and 88, by biasing means to be described later.

According to the primary aspect of the present invention, the center domer element and annular element are individually biased to the first position defined by stops 64 and 86 through a first compressible means 90 located between frame 34 and sleeve 44, and a second compressible means 92 located between frame 34 and rod 46. The first compressible means is most clearly illustrated in FIG. 2 and includes a plurality of resilient compressible members 94 that are equally circumferentially spaced around the path P as will be described later. Each resilient member 94 is in the form of an annular pneumatic or air bag 100 that has a resilient middle portion 102 and plates 104 on opposite sides of the middle portion 102. Air bag 100 is supported between first and second plates 110 and 112 with plate 110 being secured to a flange 114 that is located on the adjacent end of frame 34 and has a circular opening 116 through which rod 46 passes for a purpose that will be described later. Plate 110 is held in a fixed position on frame 34 through a plurality circumferentially spaced bolts 120 that extend through sleeves 122 located between plate 110 and flange 114. Thus, plate 110 defines a fixed position for one side of each of the three equally spaced resilient compressible members 94.

The second plate or movable plate 112 likewise has an opening 130 through which rod passes and also has slots 132 in which sleeves 122 are positioned. The respective resilient compressible members 94 therefore will force plate 112 into engagement with the enlarged portion 62 and bias the domer element to the first position ellustrated in FIG. 2 of the drawings.

The second compressible means 92 again is in the form of a resilient member or pneumatic bag 100 that is identical to each of the pneumatic bags 100 that define the first compressible means. The second compressible means or bag 100 is positioned between a first plate 140 that is secured to the rigid plate 110, which forms part of frame 34, through a plurality of bolt and sleeve arrangements 142 and 144 that are circumferentially spaced around the path P. One surface of bag 100 is held in engagement with the adjacent surface of plate 140 while the opposite surface engages a holding plate 146 secured to the end of rod 46.

First and second separate pressurizing means 150 and 152 are respectively utilized for supplying pressurized fluid to the respectively compressible means 90 and 92. The first supply or pressurizing means may be in the form of a flexible tube 154 that extends to each of the three pneumatic bags 100 for simultaneously supplying a pneumatic fluid, such as air, to the respective bags. The second pressurizing means 152 supplies pressurized pneumatic fluid to the single pneumatic member or bag 100.

Before considering the operation of the improved domer assembly, a brief description of the punch assembly and annular element appears to be in order. Preferable although not necessary, punch 14 is in the form of a sleeve (FIG. 4) that has an annular projection 162 at the free end thereof. A second member or punch 164 supports sleeve 160 and has an arcuate exposed surface 166 that is spaced inwardly therefrom.

The annular sleeve 32 has an insert 170 that defines an exposed surface 172 which cooperates with the peripheral surface of projection 162 to initially engage the inclined peripheral portion of the end wall, as will be explained later in FIGS. 4 and 5. Also, the arcuate surface 166 and the peripheral doming surface of domer element 30 are designed such that the contact between the two surfaces, when a container shell is clamped therebetween, is primarily around the periphery of arcuate surface 166, to coin the periphery of the domer of the container shell as the punch bottoms out on the domer pad.

While not necessary it may also be desirable to provide suitable lubricant between the respective bearings 50 and 71 to reduce the friction involved and this may be accomplished by supplying suitable lubricant through first and second channels 190 and 192 in the respective frame elements.

Considering the operation of the new domer assembly described above, before operation is to begin, pressurized pneumatic fluid is supplied by supply means 150 to each of the three equally spaced pneumatic bags 102 to a predetermined pressure which will be described later. Also, pressurized pneumatic fluid is supplied through supply means 152 to the individual compressible means 100. With the respective separate pressures applied through supply means 150 and 152, the center domer element is biased to a first position, defined by member 62 and surface 64 and illustrated in FIG. 2, while the annular sleeve or element 32 is biased to a first position wherein it projects beyond the peripheral surface of domer element 30. The pressure supplied through supply means 150 is substantially greater than the pressure applied through supply means 152 so that, when external forces are applied to annular element 32 and domer element 30, the domer element will remain substantially stationary while annular element 32 will move.

Figure 4:
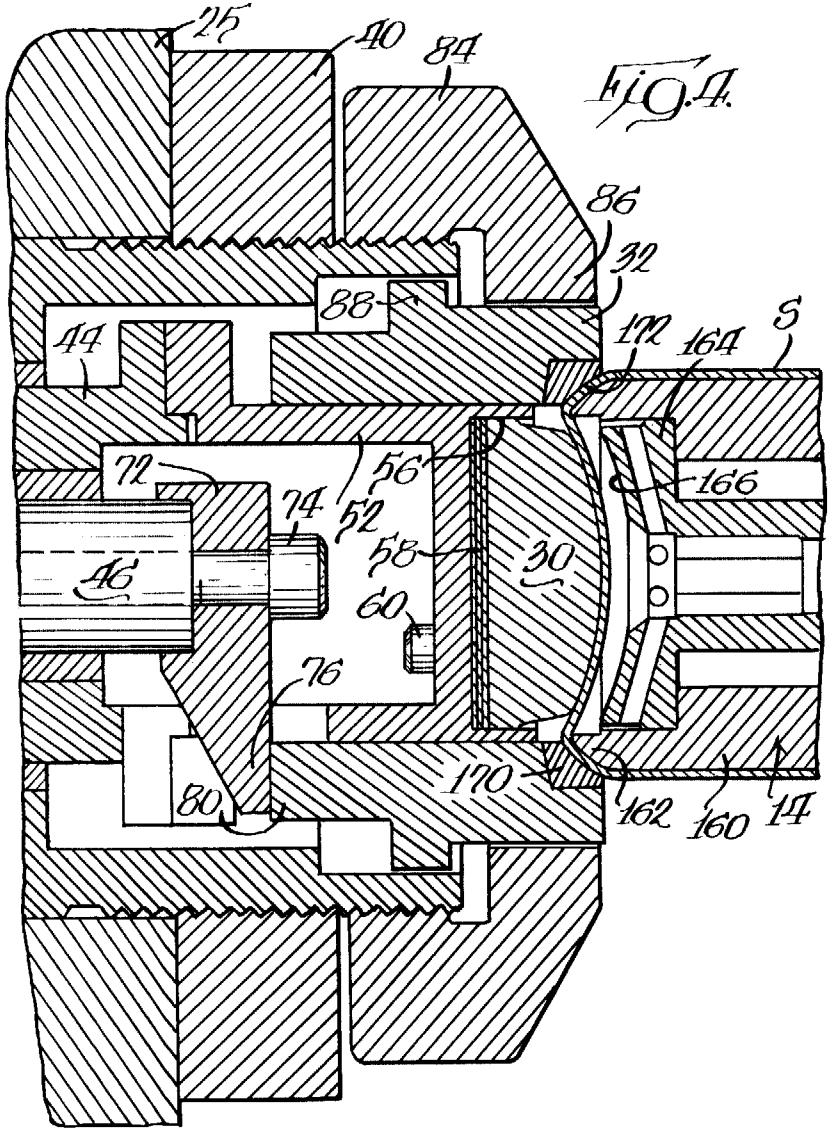
FIG. 4 of the drawings shows the components during the initial reforming of the periphery of the end wall.

Thus, as the punch initially moves from the position illustrated in FIG. 2 to the position illustrated in FIG. 4, the peripheral surface of the end wall of a container shell will clamp the annular portion of the container S between projection 162 and surface 172. This position is illustrated in FIG. 4 of the drawings.

Figure 5:
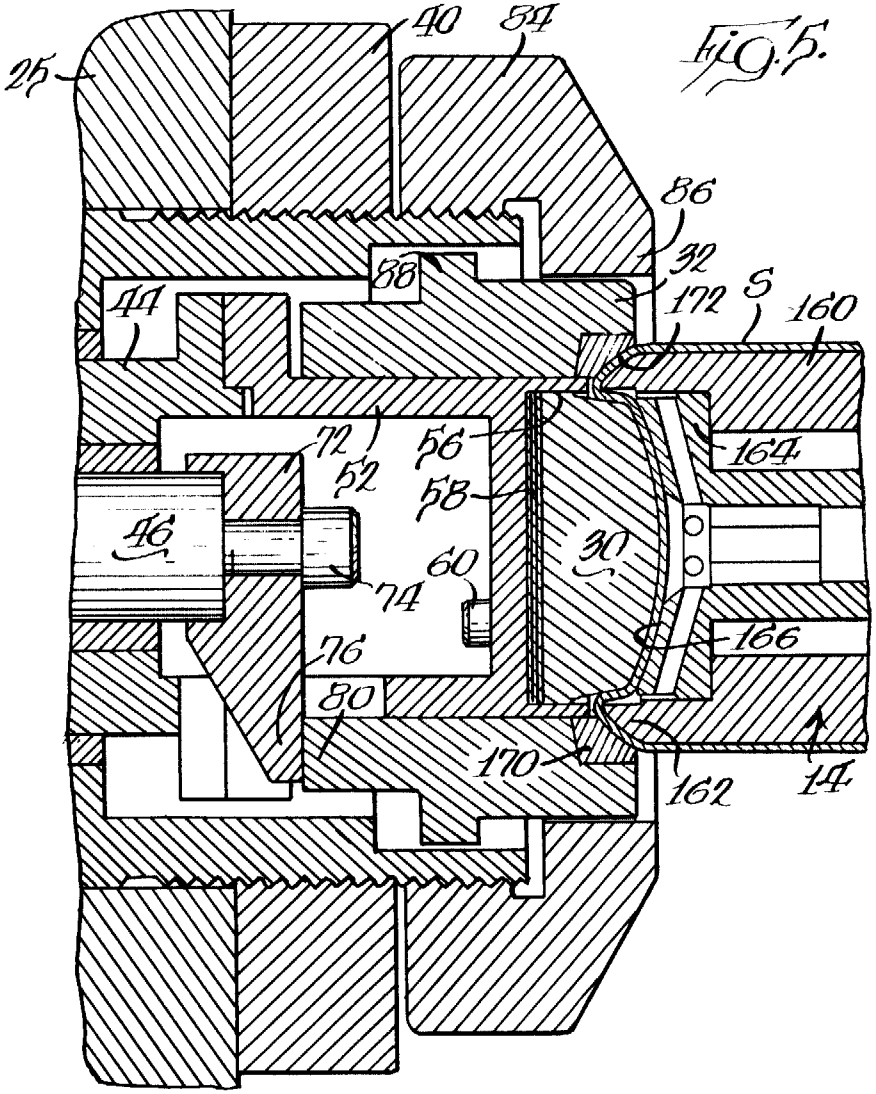
FIG. 5 is similar to FIG. 4 showing the components as they appear after the end wall has been completely reformed.

Continued movement of punch 14 to the left as viewed in FIG. 4 will initially cause domer element 30 to engage the generally flat surface of the end wall and reform the end wall to the position illustrated in FIG. 5. During this reforming operation, the annular element 32 will be moved by punch 14 and will increase the compression of the pneumatic fluid in bag 100 associated with rod 46.

While the domer die 30 forms the container bottom, the increased surface area necessary for producing the dome is obtained by stretching the metal in the end wall and also drawing metal down into the end wall from the side wall. The clamping action of the surfaces 162 and 170 will enforce stretching and suppress wrinkling of the inclined peripheral area while metal is being drawn from the side wall into the end wall of the container.

The continued movement of punch 14 to the left as viewed in FIGS. 4 and 5 will ultimately cause the center domer element 30 to bottom out against the arcuate surface 156 of punch 14 and ultimately end up in the position illustrated in FIG. 5 wherein the end wall of container shell has been reformed to the final configuration. As will be appreciated, since annular element 32 moves with punch 14, accurate control will be maintained for controlling the flow of metal from the side wall into the end wall to insure that the center portion of the end wall of container wall will be completely reformed without producing any wrinkles or other defects in the end wall during such reforming step.

According to a further aspect of the invention, the pressure applied by the first compressible means 90 is preferably at a level such that there is a slight amount of coining or metal reduction around the periphery of the center dome portion of the end wall of container shell S. Also, the pressure applied to the center domer element is such that the center domer element will move a small increment from the first position illustrated in FIG. 2 to insure that the dome is completely formed and a small amount of coining is produced around the periphery. In addition, the slight movement of the center domer element will produce a cushioning effect for the punch to slow down the large mass of the punch at the end of its stroke. The small increment of movement will also assist in initial return of the punch after it has reach the end of its stroke.

Of course, the movement of the punch during the return stroke is also assisted to some measure by the pressure of the fluid in the second compressible means 92 since the second compressible means moves from the position illustrated in FIG. 5 to the position illustrated in FIG. 2 so that the domer assembly is then in condition for receiving and reforming a subsequent container shell.

One of the significant aspects of the present invention is the fact that all of the pneumatic flexible bags are exposed for visual inspection at any time. Furthermore, all of the bags 100 are identical in construction, which, as indicated above, decreases the necessary inventory for the unique domer assembly. The respective fluid pneumatic air bags are preferably available elements sold by Firestone Industrial Products as Airstroke actuators.

In a specific application that produced wrinkle free container shells, the three circumferentially spaced air bags defining the first compressible means 90 were pressurized with an air supply maintained at about 80 PSI to produce a total force of about 3120 lbs. on center domer element or domer pad 30. The single compressible means 92 was pressurized with air at about 30 PSI to produce a force or about 540 lbs. on annular element or clamp ring 32. Thus, the force applied to the domer pad was about six times the force applied to clamp ring or annular retainer 32.

With the particular arrangement described above, standard shelf items that are manufactured on a mass production basis can be utilized for providing the necessary biasing force for the center domer element and the annular domer element.

It will also be appreciated that while a particular specific construction has been disclosed and described, various other modifications could be made without departing from the spirit of the invention. For example, the annular element 32 could in some instances be attached to sleeve 44 while the center domer element could be attached to the rod 46 with the cushioning means at the end of each member being pressurized to the desired level. However, for purposes of simplicity, identical constructions are preferred. Also, if desired, when utilizing the rod for the domer element support and the annular sleeve for the annular element support a single donut shaped compressible means 94 could be utilized at the end of the rod 46 for producing the increased force necessary and desirable on the center domer element.

As can be appreciated from the above description, a very simple domer assembly has been provided which can be incorporated into existing machinery with virtually no modification thereof. Since most machines already have some type of support member for the conventional domer element, the domer element need only be removed and the support member slightly modified to accommodate the assembly. Of course, the domer assemblies can readily be removed from the illustrated structure by merely removing cap screw 84 and nut 40 so that the entire assembly can be removed and replaced with another assembly in a matter of minutes thereby decreasing the non-production time when certain components of the domer assembly become defective.

We claim:

1. A domer assembly for use with a punch reciprocal along a path on a frame of an ironing machine to reform an end wall of a container comprising a center domer element and an annular element surrounding said center domer element, a domer support member and an annular support member respectively cooperating with said center domer element and said annular element, first compressible means connected with said domer support member and said frame and biasing said domer element toward said punch, second compressible means connected with said annular support member and said frame and biasing said annular element toward said punch, each compressible means comprising an expandable and compressible resilient member with at least one of said compressible means being constantly exposed for visual inspection, and separate pressurizing means for respective compressible means.

2. A domer assembly as defined in claim 1, in which said first compressible means includes at least three equally circumferentially spaced resilient compressible means surrounding said path.

3. A domer assembly as defined in claim 2, in which each resilient compressible member is a flexible bag.

4. A domer assembly as defined in claim 3, in which said separate pressurizing means includes first and second pneumatic supply means supplying pneumatic fluid to respective compressible means.

5. A domer assembly as defined in claim 1 in which both of said compressible means are exposed for visual inspection.

6. A domer assembly for use with a punch reciprocal along a path on a frame of an ironing machine to reform an end wall of a container shell comprising a center domer element, a first support member movable on said frame along said path with said center domer element supported on one end thereof, a plurality of independent fluid bags between said frame and an opposite end of said first support member and circumferentially spaced around said path, each of said fluid bags being fully constantly exposed for visual inspection, a first stop on said frame located in the path of movement of said first support member, supply means for supplying a pressurized pneumatic fluid to each of said fluid bags normally maintaining said first support member in engagement with said first stop and accomodating movement of said first domer element from said first position in response to extreme pressures applied to said center domer element, an annular forming element surrounding said center domer element, a second support member reciprocatable along said path with said annular forming element in engagement therewith, a second stop on said frame defining a first position for said second support, fluid bag means between said second support member and said frame, and second supply means for supplying pressurized pneumatic fluid to said fluid bag means normally maintaining said second support member in engagement with said stop, said second supply means producing a force substantially less than said first supply means.

7. A domer assembly as defined in claim 6, in which one of said first and second support members is a rod supported for movement along said path and the other is a sleeve surrounding said rod.

8. In an ironing machine for producing an ironed container having a sidewall and unitary end wall including a fixed frame having a punch movable along a predetermined axis on said frame with said punch having an annular projection surrounding an arcuate center portion, a domer assembly located at the extreme end of the stroke for said punch and having an annular element cooperating with said annular projection to reform the periphery of said end wall, and a center domer element cooperating with said arcuate center portion to reform a central portion of said end wall, and support means for said domer assembly, said support means including a first member movable along said axis and having said center domer element supported on one end thereof, a plurality of circumferentially spaced resilient fluid receiving compressible constantly exposed tubes between said first member and said frame, first supply means for supplying pneumatic fluid to said tubes, stop means between said frame and said first member defining a first position for said center domer element, a second member movable along said path and having one end engaging said annular element with said frame having a stop defining a first position, a resilient constantly exposed fluid receiving member between said second member and said frame, and second supply means for supplying pneumatic pressurized fluid to said fluid receiving member to normally maintain said second member in engagement with said stop with said annular element projecting beyond said center domer element so that said annular element initially engages the periphery of said end wall to reform said periphery and said resilient fluid receiving member is compressed to produced a holding force between said annular element and said projection while said center domer element reforms the center portion of said end wall.

9. An ironing machine as defined in claim 8, in which the pressure of said pneumatic fluid from said second supply means is sufficient to clamp a periphery of said central portion of said end wall between said domer element and said arcuate center portion.

10. A method of reforming an end wall of a metal container shell having an integral side wall with a punch movable along a path on a frame and a center domer element and a surrounding annular element cooperating with said punch, comprising the steps of reciprocating said punch along said path and supporting said center domer element and surrounding annular element adjacent the end of the stroke of said punch for movement along said path with the annular element extending beyond the center domer element, interposing a plurality of fluid bags between said frame and said center domer element at equally circumferentially spaced locations around said path, introducing a first pressurized pneumatic fluid into said fluid bags to normally maintain said center domer element in a first position, interposing at least one fluid bag between said frame and said annular element, introducing a second pressurized pneumatic fluid into said at least one fluid bag, and maintaining said first pressurized pneumatic fluid at a level substantially higher than said second pressurized pneumatic fluid so that said annular element initially engages the periphery of said end wall and subsequently moves with said punch while said at least one fluid bag compressed to produce a progressively increasing hold down force while the center of said end wall is reformed.

11. The method as defined in claim 10, in which said first pressurized fluid is maintained at a level to produce a force sufficient to coin the periphery of the center of said end wall.

12. The method as defined in claim 10, in which there are three identical fluid bags between said frame and said domer element and a single fluid bags, identical to said three bags, between said annular element and said frame.

13. A domer assembly for use with a punch reciprocal along a path on a frame of an ironing machine to reform an end wall of a container comprising a center domer element and an annular element surrounding said center domer element, a domer support member and an annular support member including a rod supported on said frame for movement along said path, said rod having a plurality of radially extending fingers on one end thereof disposed in that path of movement of said annular element, said frame having an abutment defining a first position wherein said annular element extends beyond said center domer element, first compressible means connected with said domer support member and said frame and biasing said domer element toward said punch, second compressible means connected with said annular support member and said frame and biasing said annular element toward said first position, each compressible means comprising an expandable and compressible resilient member, and separate pressurizing means for respective compressible means.

14. A domer assembly as defined in claim 13, in which said domer support member includes an annular sleeve surrounding said rod with said center domer element supported on one end of said sleeve and stop means on said frame defining a first position for said center domer element.

15. A domer assembly as defined in claim 14, in which said first compressible means includes a plurality of equal circumferentially spaced resilient compressible members between said annular sleeve and said frame.

* * * * *